US007926275B1

(12) United States Patent
Dunn

(10) Patent No.: US 7,926,275 B1
(45) Date of Patent: Apr. 19, 2011

(54) CLOSED BRAYTON CYCLE DIRECT CONTACT REACTOR/STORAGE TANK WITH CHEMICAL SCRUBBER

(75) Inventor: Paul M. Dunn, Wakefield, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 07/926,090

(22) Filed: Aug. 7, 1992

(51) Int. Cl.
*F01K 25/02* (2006.01)

(52) U.S. Cl. ..... 60/682; 60/650

(58) Field of Classification Search ..... 60/582, 60/650, 39.461, 39.15, 39.02; 114/20.2
See application file for complete search history.

(56) References Cited

U.S. PATENT DOCUMENTS

| | | | | | |
|---|---|---|---|---|---|
| 1,688,761 | A | * | 10/1928 | Sperry | 60/39.05 |
| 3,101,592 | A | * | 8/1963 | Robertson et al. | 60/39.05 |
| 3,657,879 | A | * | 4/1972 | Ewbank et al. | 60/39.05 |
| 4,680,934 | A | * | 7/1987 | Short | 114/20.2 |
| 5,117,635 | A | * | 6/1992 | Blau | 114/20.2 |
| 5,131,231 | A | * | 7/1992 | Trimble et al. | 60/650 |
| 5,177,952 | A | * | 1/1993 | Stone | 60/39.05 |

* cited by examiner

*Primary Examiner* — Christopher P Ellis
(74) *Attorney, Agent, or Firm* — James M. Kasischke; Michael P. Stanley; Jean-Paul A. Nasser

(57) ABSTRACT

A closed cycle Brayton direct contact reactor/storage tank uses a chemical scrubber to assist in removing metal vapors from the working fluid. The direct contact reactor/storage tank operates by bubbling an inert gas through liquid metal fuel. The inert gas picks up metal vapors from the fuel. The chemical scrubber is comprised of a reducible material contained within a filter at the top of the reactor/storage tank. The reducible material on reacting with the metal vapor forms components that are solids at the operating temperature and pressure, thereby preventing metal vapor from circulating throughout the system as part of the working fluid and causing damage to system components.

20 Claims, 1 Drawing Sheet

CLOSED BRAYTON CYCLE DIRECT CONTACT REACTOR/STORAGE TANK WITH CHEMICAL SCRUBBER

STATEMENT OF GOVERNMENT INTEREST

The invention described herein may be manufactured and used by or for the Government of the United States of America for governmental purposes without the payment of any royalties thereon or therefor.

This patent application is copending with the related applications by the same inventor filed on the same date as subject patent entitled Closed Cycle Brayton Propulsion System with Direct Heat Transfer Ser. No. 07/926,116, filed 7 Aug. 1992, Closed Brayton Cycle Direct Contact Reactor/Storage Tank with $O_2$ Afterburner, Ser. No. 07/926,200, filed 7 Aug. 1992, Semiclosed Brayton Cycle Power System with Direct Heat Transfer, Ser. No. 07/926,199, filed 7 Aug. 1992, and Semiclosed Brayton Cycle Power System Direct Combustion Heat Transfer, Ser. No. 07/926,115, filed Aug. 7, 1992.

BACKGROUND OF THE INVENTION (1) Field of the Invention

The present invention relates to metal vapor control of the liquid metal fuel in a direct contact Brayton cycle power system. More particularly the invention relates to a system for eliminating metal vapor at the working gas outlet of a closed Brayton cycle direct contact reactor/storage tank by use of a filter material that functions as a chemical scrubber.

(2) Description of the Prior Art

My invention titled Closed Cycle Brayton Propulsion System with Direct Heat Transfer with which this application is copending discloses the use of the more efficient Brayton cycle instead the Rankine cycle in a closed cycle underwater propulsion system. The size and weight penalty of the Brayton cycle's hot side heat exchanger is eliminated by use of direct contact heat transfer between the working fluid which is an inert gas such as helium, argon, xenon, or a mixture of inert gases, and a liquid metal bath of a material such as lithium, sodium, potassium, aluminum, magnesium, or an alloy thereof.

The closed cycle Brayton power system with direct heat transfer invention as disclosed in the copending application has the problem that some of the liquid metal fuel vapor will be carried from the reactor/fuel exchanger into the working fluid stream. The volume fraction of metal vapor is relatively low; however, during a long run of the power cycle the metal accumulation can damage the regenerator, cooler, turbine, or compressor. The volume fraction of the vapor present is equal to the ratio of the partial pressure of the liquid metal to the system operating pressure, i.e. for aluminum @ 2343° F., 1 mm Hg/−800 psi=$1.6\times10^{-6}$, for lithium @ 2323° F., 400 mm Hg/−800 psi=$6.5\times10^{-4}$.

SUMMARY OF THE INVENTION

Accordingly, it is a general purpose and object of the present invention to provide an improved reactor/storage tank for use in a direct contact closed Brayton cycle power system. It is a further object to provide metal vapor control within the reactor/storage tank to remove contaminants from the working fluid stream. Another object is to provide longer life in the power system components that come in contact with the working fluid.

These and other objects are accomplished with the present invention by providing a system in which a chemical scrubber is used. The chemical scrubber comprises a reducible material such as $Fe_2O_3$ as part of a filter media. Metal vapors which come into contact with the filter media oxidize. The metal fuel oxide, iron oxides, and iron particulate formed are all solids at closed Brayton direct contact operating temperatures and pressures, and, thus, can be easily filtered out of the working gas stream.

BRIEF DESCRIPTION OF THE DRAWINGS

A more complete understanding of the invention and many of the attendant advantages thereto will be readily appreciated as the invention becomes better understood by reference to the following detailed description when considered in conjunction with the accompanying drawings wherein.

DESCRIPTION OF THE PREFERRED EMBODIMENT

Figure 1:
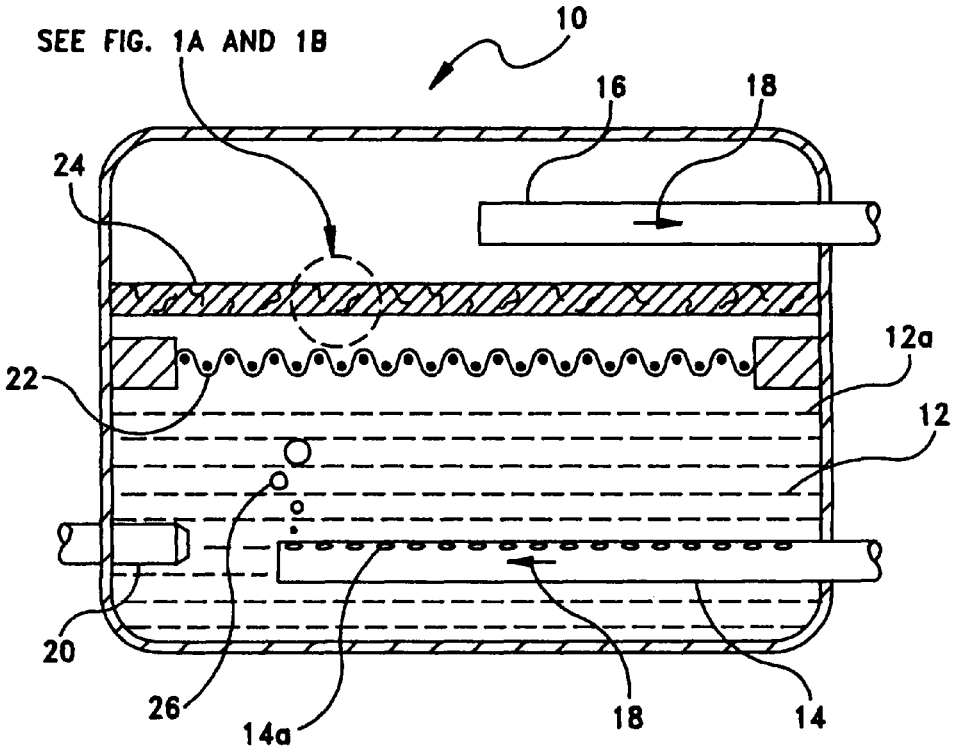
FIG. 1 shows a diagram of a closed Brayton cycle direct contact reactor/storage tank with a chemical scrubber in accordance with the present invention.

Referring now to FIG. 1 there is shown a reactor/storage tank 10 for transferring heat from a liquid metal fuel 12 to a working gas in a closed Brayton cycle power system. Although the terminology reactor/storage tank and direct contact reactor/storage tank are used to describe component 10, names such as heater/reactor and direct contact heater could be used.

In the preferred embodiment, a direct contact reactor/storage tank is partially filled with a liquid metal fuel 12. Reactor/storage tank 10 has a working gas inlet 14 disposed in reactor/storage tank 10 below the surface 12*a* of liquid metal fuel 12 for the injection of the working gas directly into liquid metal fuel 12. Working gas inlet 14 is a tube extending into reactor/storage tank 10 with a plurality of apertures 14*a* therein, disposed along the length thereof. Similarly, a working gas outlet 16 is disposed in reactor/storage tank 10 above surface 12*a* of liquid metal fuel 12 for the ejection of the working gas from reactor/storage tank 10. The flow of the working gas is designated generally by flow arrows 18. Also disposed within reactor/storage tank 10 is an oxidant injector 20. An oxidant is introduced through injector 20 into liquid metal fuel 12 where it reacts with fuel 12 to produce heat.

The oxidizing agent or oxidant in the preferred embodiment is oxygen, $O_2$. The reaction between oxygen and an aluminum-magnesium alloy liquid metal fuel provides the preferred means of generating heat within reactor/storage tank 10. The working gas is normally argon or a mixture of helium and xenon. Helium, argon and xenon are inert gases and therefore do not react with a metal fuel. Other possible choices for metal fuels include alkali metals, such as lithium, sodium or potassium.

Disposed within the reactor/storage tank 10 between the liquid metal fuel 12 and the working gas outlet 16 is a screen assembly 22 for preventing the liquid metal fuel 12 from splattering into working gas outlet 16. A filter 24, which further prevents contaminants within the working gas from entering working gas outlet 16, is disposed between screen assembly 22 and working gas outlet 16.

In operation, after the metal fuel is heated to the liquid state, the working gas is injected through working gas inlet 14 into reactor/storage tank 10. The working gas then bubbles through liquid metal fuel 12. Representative working gas bubbles 26 are shown leaving aperture 14*a* and expanding toward surface 12*a* of liquid metal fuel 12. Heat is transferred directly from liquid metal fuel 12 to the working gas. During this process metal vapors are formed.

Filter 24 functions as a chemical scrubber. It comprises a reducible material such as $Fe_2O_3$. Various designs are available for filter 24.

Figure 1A:
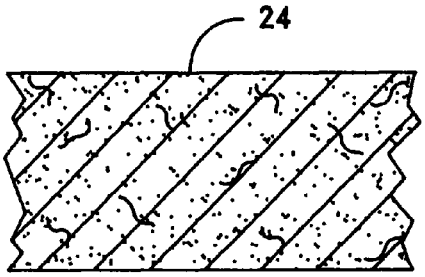
FIG. 1A shows a detail view of one embodiment of a filter in accordance with the present invention.

FIG. 1A provides a detail view of the circled portion of FIG. 1. In FIG. 1A there is shown one embodiment of the chemical scrubber filter of the current invention. This embodiment is a ceramic fiber filter media with a reducing power, such as $Fe_2O_3$, loaded therein.

Figure 1B:
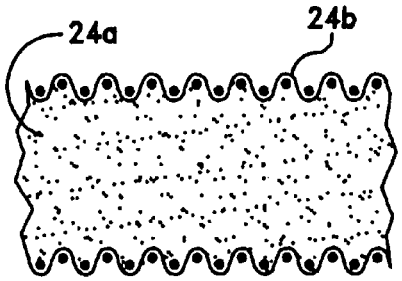
FIG. 1B shows a detail view of an alternate embodiment of a filter in accordance with the present invention.

FIG. 1B provides a detail view of another embodiment of the circled portion of FIG. 1. In this embodiment filter 24 is a powder 24*a* such as $Fe_2O_3$ captured between screens 24*b* wherein powder 24*a* is the sole filter medium.

The metal oxide powder in filter 24 oxidizes the metal vapors, reducing the $Fe_2O_3$ powder to $Fe_3O_4$, then to FeO, and finally to Fe. The products of the reducing action, the metal fuel oxide, the other oxides of iron and iron, are all solids at the Brayton cycle operating temperature and are readily trapped by filter 24.

The combination of screen assembly 22 and filter 24 clean the working gas before it passes through outlet 16.

In alternative embodiments, the liquid fuel can be one of the alkali metals such as lithium, sodium, or potassium, and the oxidant can be a chlorofluorocarbon, such as $C_2F_3Cl_3$ known in the art as Freon-13. Chlorofluorocarbon oxidants cannot be used with aluminum-magnesium fuel, however, because the products of the oxidation reaction are gaseous at the operating temperature.

There has therefore been described a reactor/storage tank 10 that is used in a closed Brayton cycle power system. The reactor/storage tank 10 has a filter 24 functioning as a chemical scrubber that is placed in the path of the working fluid to eliminate metal vapor from the working fluid. In the absence of such a filter, any metal vapor present in the circulating working fluid plates out and eventually freezes at a point in the cycle where either the partial or total pressure of the gas stream is reduced, or the gas is cooled below the melting point of the vapor. These conditions occur in the turbine, regenerator, and cooler of the direct contact Brayton power cycle. The metal deposits can reduce heat transfer in the regenerator, damage the turbine, or cause a pressure drop in any of the components.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A reactor/storage apparatus for use in a closed Brayton cycle system comprising:

a tank;

a liquid metal fuel partially filling said tank;

an oxidant;

an oxidant injector, penetrating said tank below the surface of said liquid metal fuel, for supplying said oxidant to said liquid metal fuel, said oxidant causing a heat generating reaction with said liquid metal fuel;

an inert working gas;

a working gas inlet, penetrating said tank below the surface of said liquid metal fuel, for supplying said inert working gas to said liquid metal fuel wherein heat is transferred to said working gas by direct contact with said liquid metal fuel, said working gas passing through said liquid metal fuel and becoming contaminated with metal vapors from said liquid metal fuel;

chemical scrubbing means, located within said tank and disposed above said liquid metal, said chemical scrubbing means having a reducible material for causing said metal vapors to oxidize thereby forming a solid and a solid metal fuel oxide; and a working gas outlet, penetrating said tank above said liquid metal fuel, for providing said working gas to said closed Brayton cycle system.

2. A reactor/storage apparatus for use in a closed Brayton cycle system according to claim 1 wherein said chemical scrubbing means reducible material further comprises $Fe_2O_3$.

3. A reactor/storage apparatus for use in a closed Brayton cycle system according to claim 2 wherein said chemical scrubbing means further comprises a ceramic fiber filter, said reducible material being a powder retained in said ceramic fiber filter by said ceramic fibers in said filter.

4. A reactor/storage apparatus for use in a closed Brayton cycle system according to claim 3 wherein said liquid metal fuel comprises an aluminum magnesium alloy.

5. A reactor/storage apparatus for use in a closed Brayton cycle system according to claim 4 wherein said oxidant comprises $O_2$.

6. A reactor/storage apparatus for use in a closed Brayton cycle system according to claim 5 wherein said working gas comprises argon.

7. A reactor/storage apparatus for use in a closed Brayton cycle system according to claim 5 wherein said working gas comprises a mixture of helium and xenon.

8. A reactor/storage apparatus for use in a closed Brayton cycle system according to claim 3 wherein said liquid metal fuel comprises an alkali metal.

9. A reactor/storage apparatus for use in a closed Brayton cycle system according to claim 8 wherein said oxidant is a chlorofluorocarbon.

10. A reactor/storage apparatus for use in a closed Brayton cycle system according to claim 9 wherein said working gas comprises argon.

11. A reactor/storage apparatus for use in a closed Brayton cycle system according to claim 9 wherein said working gas comprises a mixture of helium and xenon.

12. A reactor/storage apparatus for use in a closed Brayton cycle system according to claim 2 wherein said chemical scrubbing means further comprises:

an upper filter member; and a lower filter member joined to said upper filter member;

said reducible material being a powder captured between said upper and lower filter members.

13. A reactor/storage apparatus for use in a closed Brayton cycle system according to claim 12 wherein said liquid metal fuel comprises an aluminum magnesium alloy.

14. A reactor/storage apparatus for use in a closed Brayton cycle system according to claim 13 wherein said oxidant comprises $O_2$.

15. A reactor/storage apparatus for use in a closed Brayton cycle system according to claim 14 wherein said working gas comprises argon.

16. A reactor/storage apparatus for use in a closed Brayton cycle system according to claim 14 wherein said working gas comprises a mixture of helium and xenon.

17. A reactor/storage apparatus for use in a closed Brayton cycle system according to claim 12 wherein said liquid metal fuel comprises an alkali metal.

18. A reactor/storage apparatus for use in a closed Brayton cycle system according to claim 17 wherein said oxidant is a chlorofluorocarbon.

19. A reactor/storage apparatus for use in a closed Brayton cycle system according to claim 18 wherein said working gas comprises argon.

20. A reactor/storage apparatus for use in a closed Brayton cycle system according to claim 18 wherein said working gas comprises a mixture of helium and xenon.

* * * * *